US008979229B2

(12) United States Patent
Toyama

(10) Patent No.: US 8,979,229 B2
(45) Date of Patent: Mar. 17, 2015

(54) LIQUID JETTING APPARATUS

(71) Applicant: Reiko Toyama, Iwakura (JP)

(72) Inventor: Reiko Toyama, Iwakura (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/156,694

(22) Filed: Jan. 16, 2014

(65) Prior Publication Data

US 2014/0204146 A1 Jul. 24, 2014

(30) Foreign Application Priority Data

Jan. 21, 2013 (JP) ..... 2013-008006

(51) Int. Cl.
*B41J 29/38* (2006.01)
*B41J 2/045* (2006.01)

(52) U.S. Cl.
CPC ..... *B41J 2/04563* (2013.01); *B41J 2/04508* (2013.01); *B41J 2/04551* (2013.01); *B41J 2/04586* (2013.01)
USPC ..... 347/9

(58) Field of Classification Search
CPC .. B41J 2/0454; B41J 2/04563; B41J 2/04553; B41J 2/38
See application file for complete search history.

(56) References Cited

U.S. PATENT DOCUMENTS

| | | | |
|---|---|---|---|
| 6,345,878 | B1 | 2/2002 | Kanaya |
| 2002/0054183 | A1 | 5/2002 | Kanaya |
| 2010/0128077 | A1 | 5/2010 | Sugahara |

FOREIGN PATENT DOCUMENTS

| | | |
|---|---|---|
| JP | 06126965 | 5/1994 |
| JP | 08276592 | 10/1996 |
| JP | 2001/334686 | 12/2001 |
| JP | 2010/125598 | 6/2010 |

*Primary Examiner* — Julian Huffman
(74) *Attorney, Agent, or Firm* — Frommer Lawrence & Haug LLP

(57) ABSTRACT

A liquid jetting apparatus includes a first head unit and a second head unit, each of the head units including nozzles through which a liquid is discharged; a head drive section configured to drive the first head unit and the second head unit; a controller configured to control the head drive section to selectively execute a first drive mode in which both of the first head unit and the second head unit are driven and a second drive mode in which only the second head unit is driven; and a heating element configured to generate heat under a condition that the head drive section executes the first drive mode and the second drive mode. The second head unit is arranged at a position separated farther from the heating element than the first head unit.

16 Claims, 8 Drawing Sheets

LIQUID JETTING APPARATUS

CROSS REFERENCE TO RELATED APPLICATION

The present application claims priority from Japanese Patent Application No. 2013-008006, filed on Jan. 21, 2013, the disclosure of which is incorporated herein by reference in its entirety.

BACKGROUND OF THE INVENTION

1. Field of the Invention

The present invention relates to a liquid jetting apparatus provided with a plurality of head units.

2. Description of the Related Art

In the field of a liquid jetting apparatus, there is known a liquid jetting apparatus configured so that a plurality of head units, each of which includes nozzles through which a liquid is discharged, are combined. For example, there is known a line-type ink-jet head in which the head units are arranged in a zigzag or staggered form in a main scanning direction (a width direction of a recording paper).

There is conventionally known a problem that jetting characteristics (an amount of liquid droplets to be discharged and jetting speed of the liquid droplets) of each nozzle change depending on variation in a physical property of the liquid caused by temperature change, such as the change of viscosity of the liquid. It is considered that the change of the liquid temperature is caused by variation in the temperature of an ambient environment, but a more severe problem occurs in a case that a drive unit for driving the head unit and a heating element such as a power unit are arranged in the vicinity of the head unit. In this case, there is fear that the heat radiated from the heating element at the time of driving the head unit increases the temperature of the liquid in the head unit and thereby changing the jetting characteristics of each nozzle greatly.

Meanwhile, for example, in a case that a printer performs printing for various kinds of paper having mutually different widths, instead of using all of the head units, only some of the head units are used depending on a condition such as a paper width, in some cases. Then, in the case that only some of the head units are used, in order to always maintain desired jetting characteristics, at least some of the head units, among the plurality of head units, which may be used by themselves, are desirably to be configured to have the least influence of the heat caused by the heating element.

SUMMARY OF THE INVENTION

An object of the present teaching is to suppress the influence of heat caused by a heating element as much as possible especially in some head units which may be used by themselves.

According to a first aspect of the present teaching, there is provided a liquid jetting apparatus, including: a first head unit and a second head unit, each of the head units including nozzles through which a liquid is discharged; a head drive section configured to drive the first head unit and the second head unit; a controller configured to control the head drive section to selectively execute a first drive mode in which both of the first head unit and the second head unit are driven and a second drive mode in which only the second head unit is driven; and a heating element configured to generate heat under a condition that the head drive section executes the first drive mode and the second drive mode, wherein the second head unit is arranged at a position separated farther from the heating element than the first head unit.

In the first aspect of the present teaching, in a case that the first drive mode is selected, the head drive section drives both of the first head unit and the second head unit to discharge the liquid from the nozzles of both of the units. In a case that the second drive mode is selected, the head drive section drives only the second head unit to discharge the liquid from the nozzles of the second head unit. Here, in a case that the head drive section drives each head unit, a temperature of the liquid in each head unit increases due to heat radiated from the heating element. In the present teaching, the second head unit is arranged at a position separated farther from the heating element than the first head unit. Therefore, in the case that the second drive mode is executed, the second head unit used in the second drive mode has a small change of the liquid temperature due to the heat from the heating element. Thus, the change in jetting characteristics is suppressed and the liquid can be discharged satisfactorily.

According to a second aspect of the present teaching, there is provided a liquid jetting apparatus, including: at least three head units, each of which includes nozzles through which a liquid is discharged; a head drive section configured to drive the head units; a controller configured to control the head drive section; and a heating element configured to generate heat under a condition that the head drive section drives the head units, wherein the head units include at least one first head unit arranged close to the heating element and a plurality of second head units, each of which is arranged at a position separated farther from the heating element than the at least one first head unit; at least one first temperature detecting section configured to individually detect a temperature of the liquid of the at least one first head unit is provided for the at least one first head unit individually; at least one second temperature detecting section configured to detect a temperature at a position, at which the at least one second temperature detecting section is arranged, as a temperature of the liquid of the second head units is provided commonly for the second head units; and the number of the second temperature detecting section is fewer than the number of the second head units.

By referring to the temperature detected by each temperature detecting section and performing the temperature correction at the time of driving each head unit, it is possible to suppress the change in the jetting characteristics owing to the influence of heat. Further, in the present teaching, the wording "the first temperature detecting section is provided in the first head unit individually" means that one first temperature detecting section is provided exclusively for one first head unit, irrespective of the number of the first head units. With respect to at least one first head unit, among at least three head units, which is arranged close to the heating element, the liquid temperature changes greatly due to the influence of heat by the heating element. Therefore, the dedicated temperature detecting section is provided for the at least one first head unit (in a case that there are a plurality of first head units, the dedicated temperature detecting section is provided for each of the first head units), and thereby making it possible to correct the temperature accurately. On the other hand, with respect to each of the second head units positioned to be separated farther from the heating element than the at least one first head unit, the change in the liquid temperature is small as compared with the at least one first head unit, and temperature variation in the second head units is also small. Thus, the number of the second temperature detecting section provided for the second head units is fewer than the number of the second head units. Accordingly, production cost can be reduced.

DESCRIPTION OF THE EMBODIMENTS

Hereinbelow, an embodiment of the present teaching will be explained. This embodiment is an example where the present teaching is applied to an ink-jet printer which jets an ink onto a print paper to perform printing of an image, a letter, and the like.

Figure 1:
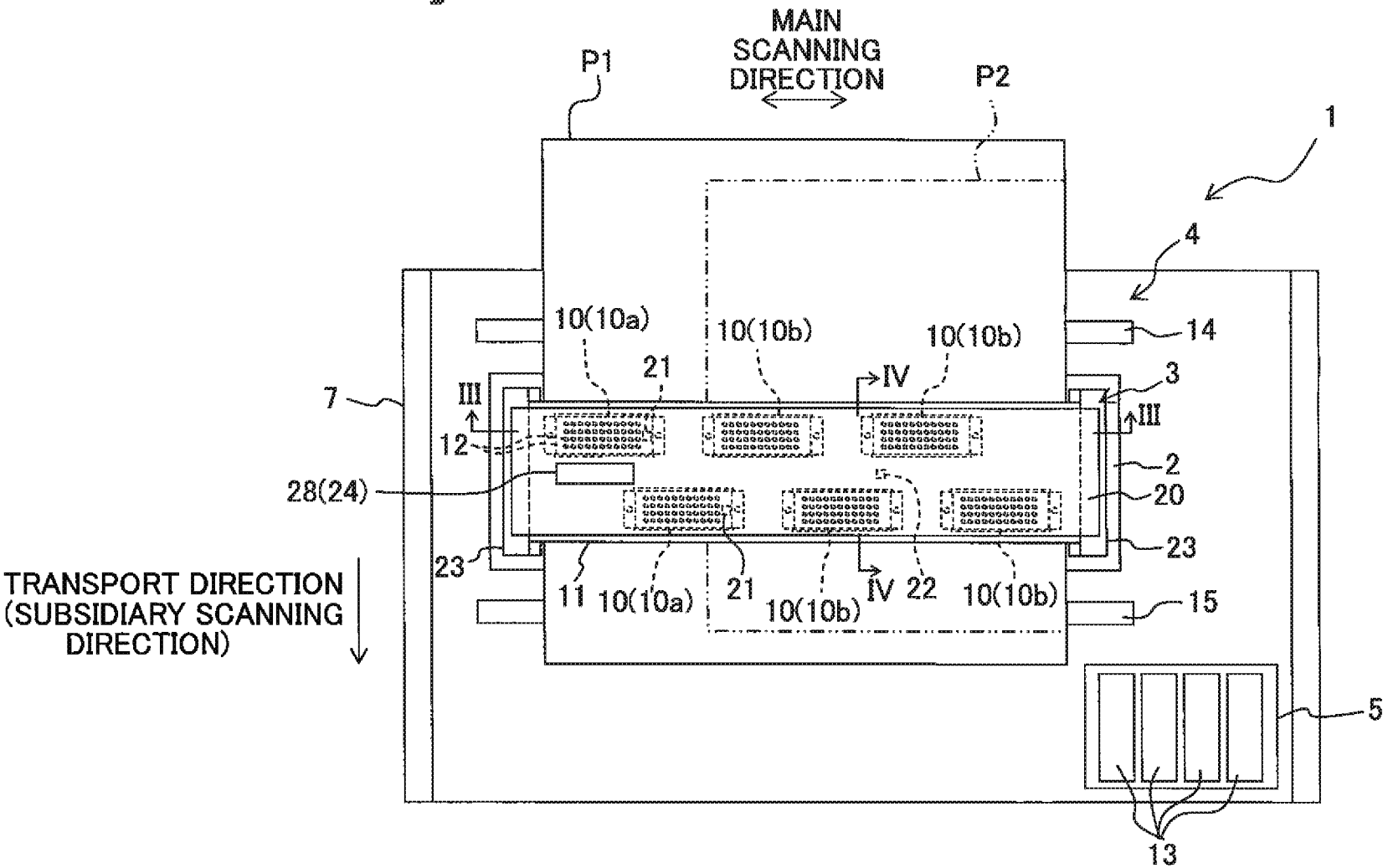
FIG. 1 is a schematic plan view of a printer according to an embodiment.

As shown in FIG. 1, an ink-jet printer 1 (also simply referred to as a printer 1 hereinbelow) includes a platen 2, an ink-jet head 3, a transport mechanism 4, a holder 5, a controller 6 (see FIG. 2), and the like. An up-down direction in FIG. 1 (subsidiary scanning direction: transport direction of the print paper) is defined as a front-rear direction, a left-right direction in FIG. 1 (main scanning direction) is defined as a left-right direction, and a direction perpendicular to the sheet surface of FIG. 1 is defined as an up-down direction (the front side of the page of FIG. 1 is defined to be an upper side). In the following, the explanation will be made by using the directional terms "front-rear", "left-right", and "up-down" as appropriate.

The platen 2 is provided horizontally in a casing 7 of the printer 1 and a print paper P, which is an object (medium) onto which the ink jetted from the ink-jet head 3 lands, is placed on the upper surface of the platen 2. The ink-jet head 3 is arranged above the platen 2 (the front side of the page of FIG. 1) with a spacing distance intervening therebetween. The ink-jet head 3 is a so-called line-type ink-jet head, and has six head units 10 arranged in a zigzag or staggered form in the main scanning direction. The six head units 10 are held by a plate-shaped head holder 11.

A plurality of nozzles 12, which are open in the downward direction, are formed on the lower surface of each of the head units 10. The nozzles 12 are arranged in four arrays along the main scanning direction. In this embodiment, as shown in FIG. 1, the transport direction in which the print paper P is transported (subsidiary scanning direction) is perpendicular to the main scanning direction as the arrangement direction of the nozzles 12. However, the transport direction (subsidiary scanning direction) may intersect with the main scanning direction at an angle other than 90 degrees.

Four ink cartridges 13, which store four colors of inks (black, yellow, cyan, magenta) respectively, are detachably installed to the holder 5. Each of the head units 10 of the ink-jet head 3 is connected to the four ink cartridges 13 of the holder 5 via unillustrated tubes. Accordingly, the four colors of inks are respectively supplied from the four ink cartridges 13 to each of the head units 10. Each of the head units 10 discharges the four colors of inks from the four nozzle arrays respectively toward the print paper P on the platen 2. Although the four colors of inks (black, yellow, cyan, magenta) are discharged in this embodiment, the inks discharged are not limited to these four colors (black, yellow, cyan, magenta).

The transport mechanism 4 includes a supply roller 14 and a discharge roller 15 which are arranged to sandwich the ink-jet head 3 therebetween in the transport direction. A transport motor 16 (see FIG. 2) drives and rotates the supply roller 14 and the discharge roller 15. The transport mechanism 4 transports the print paper P, which is supplied from the rear to the platen 2 by an unillustrated paper feed mechanism, forward relative to the ink-jet head 3 by the two rollers 14, 15.

As shown in FIG. 1, the transport mechanism 4 is capable of transporting two kinds of print paper P1 and P2 (for example, A4 paper and B5 paper) having mutually different paper widths (different widths in the main scanning direction). In a case that a first print paper P1 (corresponding to a first medium, for example the A4 paper) having a large width is transported, the printer 1 uses all of the six head units 10 of the ink-jet head 3 to perform the printing over the entire width of the first print paper P1. Meanwhile, the transport mechanism 4 transports a second print paper P2 (corresponding to a second medium, for example the B5 paper) having a small width in a state that the second print paper P2 is positioned on one side (right side in FIG. 1) of a transport area of the first print paper P1 in the main scanning direction. For example, the second print paper P2 is moved to the right side of FIG. 1 by using an unillustrated paper guide. Thus, in the case that the second print paper P2 is transported, the printer 1 uses only four head units 10*b* positioned on the right side, among the six head units 10 of the ink-jet head 3, to perform the printing on the second print paper P2. In the following description, two head units 10 positioned on the left side, which are used for the printing on the first print paper P1, but are not used for the printing on the second print paper P2, are also referred to as "first head units 10*a*". Further, the four head units 10 positioned on the right side, which are used for both the printing on the first print paper P1 and the printing on the second print paper P2, are also referred to as "second head units 10*b*".

Figure 2:
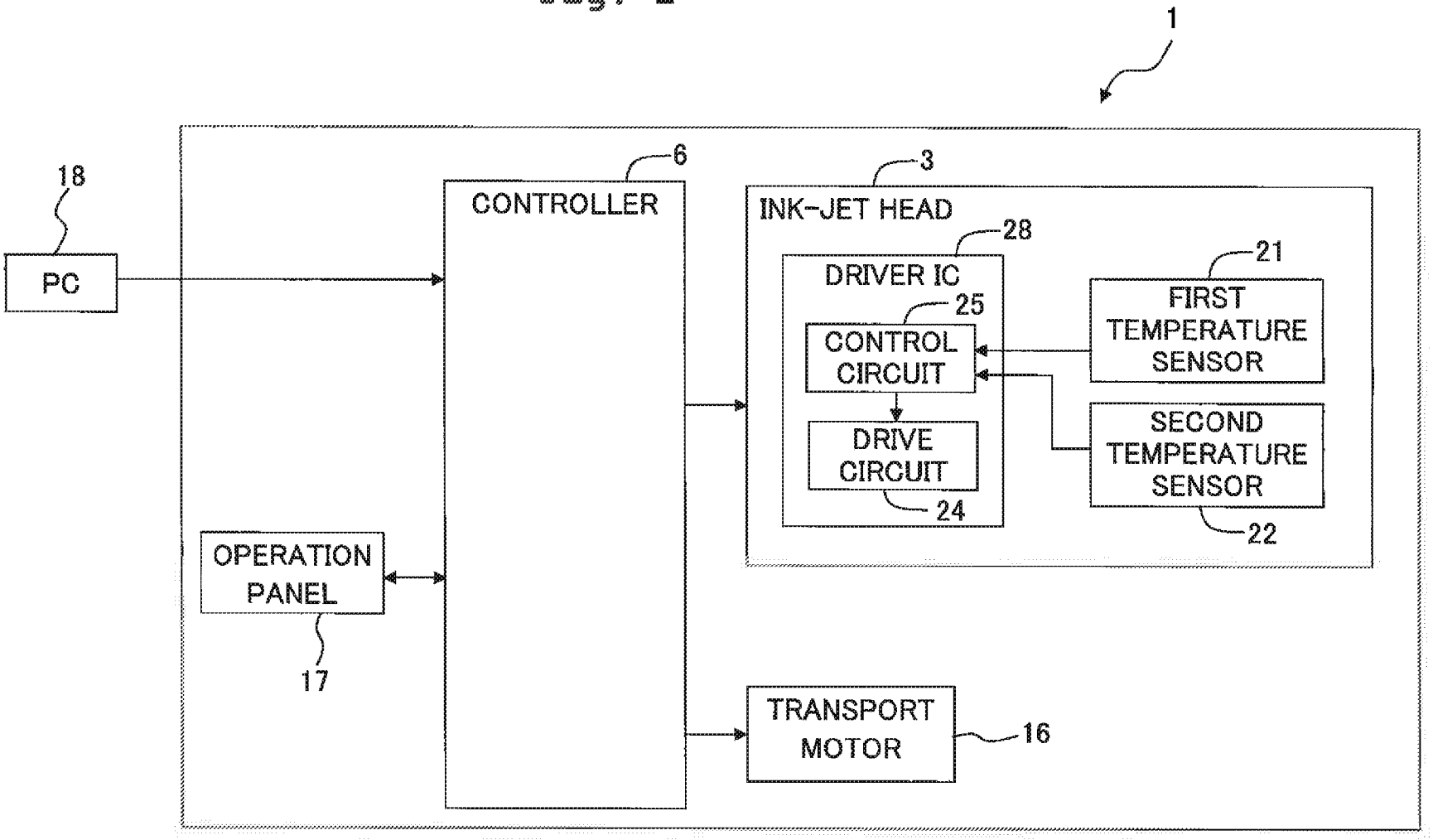
FIG. 2 is a block diagram schematically showing an electrical structure of the printer.

The controller 6 shown in FIG. 2 includes a CPU (Central Processing Unit), a ROM (Read Only Memory), a RAM (Random Access Memory), an ASIC (Application Specific Integrated Circuit) including various control circuits, and the like. As shown in FIG. 2, the controller 6 is connected to various units or mechanisms constructing the printer 1 such as the ink-jet head 3 and the transport motor 16 of the transport mechanism 4. Further, the controller 6 is also connected to an operation panel 17 and a PC 18 as an external device.

The controller 6 executes a print process described below by the CPU and the ASIC in accordance with a program stored in the ROM. That is, the controller 6 controls the ink-jet head 3, the transport motor 16, and the like, based on a print command transmitted from the PC 18 to perform the printing of the image, the letter, and the like onto the print paper P. More specifically, the ink is discharged from each of the head units 10 of the ink-jet head 3 toward the print paper P placed on the platen 2. Further, the print paper P is transported in the transport direction by a predetermined amount using the two rollers 14, 15 of the transport mechanism 4. The image, etc., is printed on the printer paper P by repeating the ink discharging operation by the ink-jet head 3 and the transport operation of the print paper P by the transport mechanism 4 alternately. In this embodiment, although the controller 6 includes the CPU, the ROM, the RAM, and the ASIC, the present teaching is not limited thereto and the controller 6 may be constructed by any hardware. For example, the controller 6 may be achieved by dividing the functions among two or more CPUs or two or more ASICs.

Figure 3:
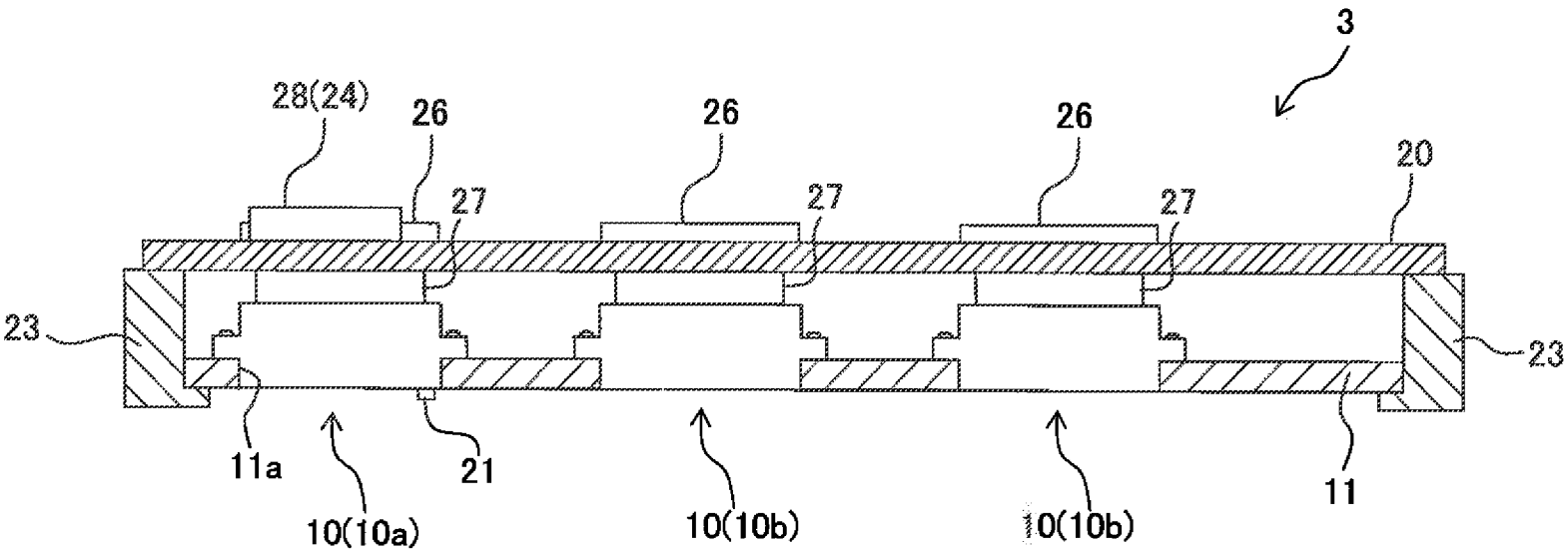
FIG. 3 is a cross-sectional view taken along the line III-III of FIG. 1.
Figure 4:
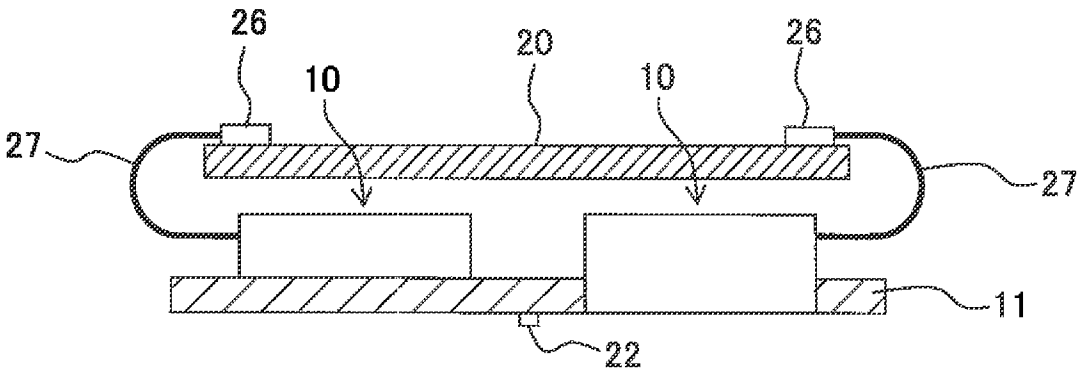
FIG. 4 is a cross-sectional view taken along the line IV-IV of FIG. 1.

Next, an explanation will be made about a concrete structure of the ink-jet head 3. As shown in FIGS. 1, 3, and 4, the ink-jet head 3 includes the six head units 10, the head holder 11, a head substrate 20, and the like.

As described above, the nozzles 12 of each of the head units 10 are arranged in the four arrays corresponding to the four colors of inks. Each of the head units 10 is inserted into one of installation holes 11*a* formed in the head holder 11 and is fixed to the head holder 11 with screws. As shown in FIG. 1, the head holder 11 is a plate-shaped member which is rectangular as viewed in a plan view and is arranged so that the longitudinal direction of the head holder 11 is identical with the main scanning direction. The head holder 11 is supported by a support member 23 provided in the casing 7 of the printer 1 at its both end portions in the longitudinal direction.

Temperature sensors for detecting the temperature of ink in each of the head units 10 are provided for the ink-jet head 3. In particular, as shown in FIGS. 1 and 3, a first temperature sensor 21 (first temperature detecting section) is individually provided on the lower surface of each of the two first head units 10*a*, of the six head units 10, positioned on the left side. Meanwhile, as shown in FIGS. 1 and 4, a second temperature sensor 22 (second temperature detecting section) is provided commonly for the four second head units 10*b*, on the lower surface of the head holder 11, at a portion at which the four second head units 10*b* positioned on the right side are installed. More specifically, as shown in FIG. 1, the second temperature sensor 22 is arranged substantially in the center of an area, in which the four second head units 10*b* are disposed, as viewed in a plan view. The reason why only the first temperature sensor 21 is individually provided in each of the two first head units 10*a* positioned on the left side will be described later in detail. A thermistor is suitably used as each of the temperature sensors 21, 22, and in addition to this, a thermocouple may be used.

Further, in order to detect the temperature of the ink in the nozzles 12 with high accuracy, the temperature sensors 21, 22 are preferably arranged as close as possible to the nozzles 12. Therefore, in this embodiment, the first temperature sensor 21 is provided on the lower surface (liquid droplet jetting surface), of each of the head units 10*a*, on which the nozzles 12 are formed, and the second temperature sensor 22 is provided on the lower surface, of the head holder 11, which is communicated with the lower surface of each of the head units 10*b*.

The head substrate 20 is a substrate which is rectangular as viewed in a plan view, and the head substrate 20 is disposed above the six head units 10. As shown in FIG. 3, the head substrate 20 is fixed in a state of being placed on the upper end surfaces of the two support members 23. The head substrate 20 is connected to the controller 6 (see FIG. 2) of the printer 1, and various signals are sent to the head substrate 20 from the controller 6.

A driver IC 28 is provided on the upper surface of the head substrate 20. In particular, the driver IC 28 is provided above the two head units 10*a* positioned on the left side. As shown in FIG. 2, a drive circuit 24 (head drive section) driving each of the six head units 10 and a control circuit 25 (controller) controlling the drive circuit are incorporated into the driver IC 28. Although illustration is omitted in FIG. 1, as understood from FIGS. 3 and 4, six connectors 26 are provided in the head substrate 20, and the six connectors 26 are respectively connected to the six head units 10 by wiring boards 27 such as FPC. Further, a temperature detection signal is inputted from each of the first temperature sensor 21 and the second temperature sensor 22 to the driver IC 28. The control circuit 25 causes the drive circuit 24 to generate a drive signal for driving each of the head units 10 based on various signals inputted from the controller 6 and the temperature detection signals inputted from the temperature sensors 21, 22. The drive signal outputted from the drive circuit 24 of the driver IC 28 is supplied to each of the head units 10 via each of the wiring boards 27.

In a case that the first print paper P1 having the large width is transported by the transport mechanism 4, the control circuit 25 causes the drive circuit 24 to drive all of the six head units 10 so that the ink is discharged from the nozzles 12 of each of the head units 10 (first drive mode). Meanwhile, in a case that the second print paper P2 having the small width is transported by the transport mechanism 4, the control circuit 25 causes the drive circuit 24 to drive only the four second head units 10*b* positioned on the right side so that the ink is discharged from the nozzles 12 of the second head units 10*b* (second drive mode).

In a case that the printing is performed on the first print paper P1 or the second print paper P2, the driver IC 28 having the drive circuit 24 which drives each head unit 10 is a heating element which generates heat in the interior thereof. The heat conducted from the driver IC 28 to the surroundings increases the temperature of the ink in each of the head units 10, and thereby changing the characteristics of the ink such as the viscosity. As a result, the jetting characteristics of each nozzle 12 (an amount of liquid droplets of the ink to be discharged and jetting speed of the liquid droplets)) also change. Further, since the six head units 10 have different separation distances from the driver IC 28 as the heating element, the six head units 10 have varying degrees of change in the ink temperatures. In other words, each of the two first head units 10*a*, which is positioned on the left side and close to the driver IC 28, has the ink temperature higher than that of each of the four head units 10*b*, which is positioned on the right side and far from the driver IC 28.

As shown in FIG. 1, in the case that the printing is performed on the second print paper P2 having the small width in this embodiment, the second print paper P2 is transported in a state of being positioned on the right side, that is, a side separated from the driver IC 28, within a range in which the first print paper P1 having the large width is transported. The printing on the second print paper P2 is performed by using only the four second head units 10*b* positioned far from the driver IC 28. Therefore, in the case that the printing is performed on the second print paper P2 (when the second drive mode using only the second head units 10*b* is executed), the change of the ink temperature in each of the head units 10 used for the printing is small. Accordingly, the change in the jetting characteristics of each nozzle 12 is suppressed and thereby making it possible to jet the ink satisfactorily.

The above description can be restated as follows. That is, by arranging the driver IC 28 driving the six head units 10 on the side far from the four second head units 10*b* which are used by themselves for the printing by the second drive mode, at least when the second head units 10*b* are used by themselves (the printing is performed on the second paper print P2), it is possible to reduce the change in the jetting characteristics of each head unit 10 used for the printing.

The first temperature sensor 21 is individually provided for each of the two first head units 10*a* positioned close to the driver IC 28. The control circuit 25 in the driver IC 28 controls the drive circuit 24 at the time of driving each of the two first head units 10*a* by referring to the ink temperature detected by the first temperature sensor 21. That is, by correcting or compensating the temperature at the time of driving each of the first head units 10*a*, it is possible to suppress the change in the jetting characteristics associated with the change of the ink temperature. The temperature correction is exemplified, for example, by adjustment of a voltage and/or a signal waveform of the drive signal supplied from the drive circuit 24 to each of the first head units 10*a* depending on the temperature detected by the temperature sensor 21. Further, since the dedicated first temperature sensor 21 is provided in each of the first head units 10*a* as shown in FIG. 1, the temperature of the ink can be detected with high accuracy in each of the first head units 10*a* in which the ink temperature changes greatly, and the temperature correction can be performed more accurately.

Further, the second temperature sensor 22 is provided commonly for the four second head units 10*b* arranged far from the driver IC 28. The control circuit 25 controls the drive circuit 24 at the time of driving each of the four second head units 10*b* by referring to a temperature at a position, at which the second temperature sensor 22 is arranged, detected by the second temperature sensor 22 as a temperature of the ink of the four second head units 10*b*. Accordingly, also in each of the second head units 10*b*, it is possible to suppress the change in the jetting characteristics associated with the change of the ink temperature.

However, since the second head units 10*b* are positioned separated farther from the driver IC 28 than the first head units 10*a*, the change of the ink temperature in each of the second head units 10*b* is smaller than that in each of the first head units 10*a* and temperature variation in the four second head units 10*b* is also small. Therefore, unlike the first head units 10*a*, the second head units 10*b* are not required to have the temperature sensor individually. In view of this, by providing one second temperature sensor 22 commonly for the four second head units 10*b*, the number of the second temperature sensor 22 is fewer than the number of the second head units 10*b*. Accordingly, a cost can be reduced.

Figure 5:
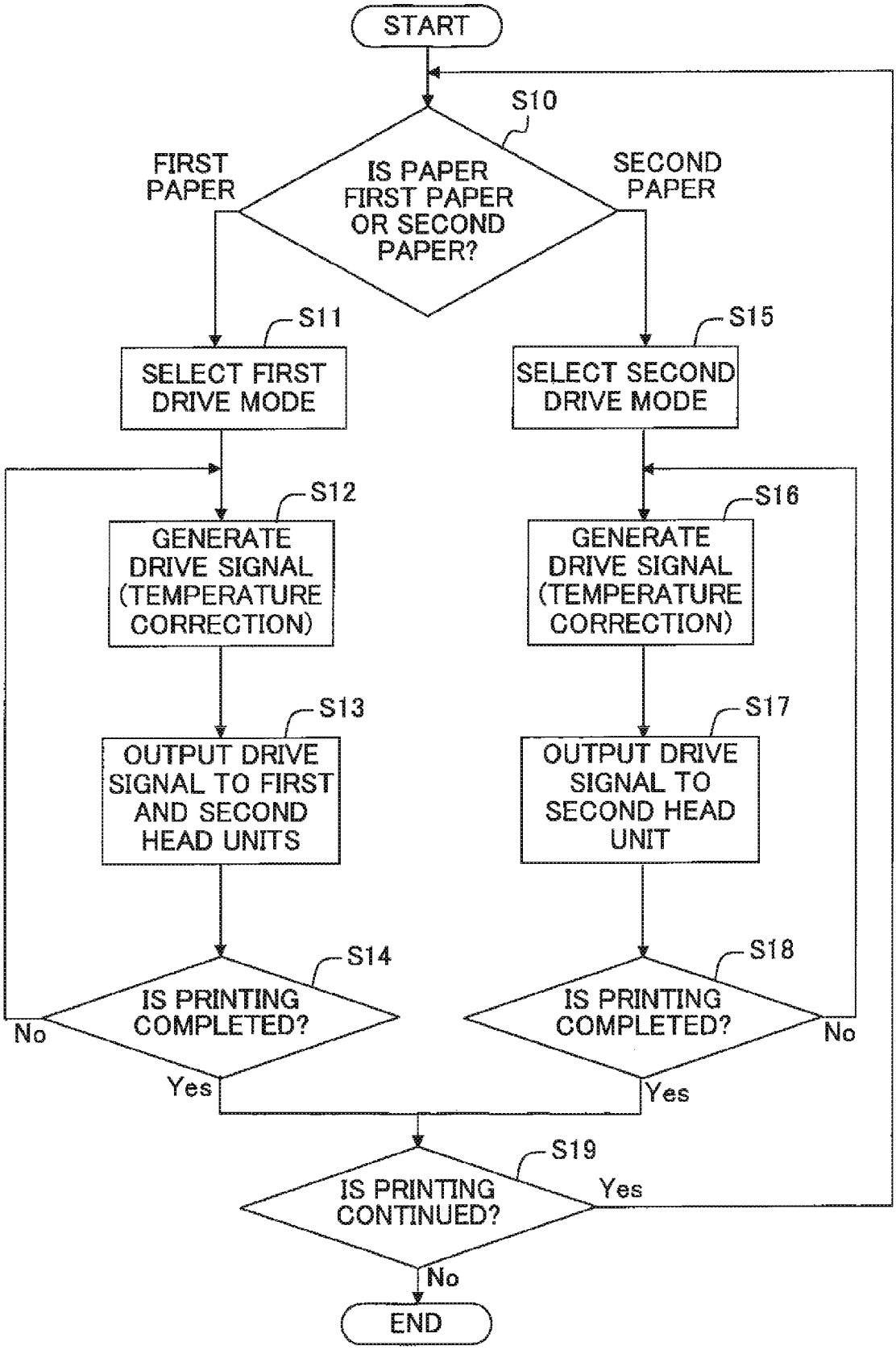
FIG. 5 is a flowchart for a print process.

Next, an explanation will be made about the print process for the first print paper P1 and the second print paper P2 using the ink-jet head 3 which is performed by the controller 6 and the control circuit 25 in the driver IC 28 while referring to FIG. 5. In FIG. 5, Si (i=10, 11, 12 . . . ) indicates a step number. In this embodiment, the control circuit 25 controlling the drive circuit 24 corresponds to the "controller" of the present teaching.

In a case that the print command is inputted from the PC 18 (see FIG. 2), the controller 6 judges the type of print paper P to be used (S10), and allows the transport mechanism 4 to transport the print paper P of the type judged in S10. The type of print paper P is judged, for example, as follows. That is, in a case that information designating the type of print paper P and a data relating to an image to be printed are transmitted from the PC 18, the controller 6 accepts the information. Alternatively, the controller 6 may judge which type of print paper P is used based on the data of the image to be printed transmitted from the PC 18.

<First Drive Mode>

In a case that the controller 6 judges in S10 that the printing for the first print paper P1 having the large width is performed, the control circuit 25 selects the first drive mode for allowing the drive circuit 24 to drive all of the six head units 10 upon the judgment (S11). In a case that the first drive mode is selected, the drive circuit 24 generates a drive signal having a predetermined waveform for each of the six head units 10 (S12).

Here, for each of the two first head units 10*a*, the control circuit 25 refers to the temperature detected by the first temperature sensor 21, which is individually provided for each first head unit 10*a*, and the correction of the drive signal is performed depending on the detected temperature. For each of the four second units 10*b*, the control circuit 25 refers to the temperature at the position, at which the second temperature sensor 22 is arranged, which is detected by the commonly-provided second temperature sensor 22 as the temperature of the ink of the four second units 10*b* and the correction of the drive signal is performed depending on the detected temperature.

In the case that the temperature correction is performed, the reference frequency of the first temperature sensor 21 may be different from the reference frequency of the second temperature sensor 22. That is, the reference frequency of the temperature detected by the first temperature sensor 21 in order to control each first head unit 10*a* is made to be higher than the reference frequency of the temperature detected by the second temperature sensor 22 in order to control the second head units 10*b*. Since each of the first head units 10*a* is positioned close to the driver IC 28, the ink temperature changes greatly. Therefore, in order to perform the temperature correction with high accuracy, the reference frequency of the temperature is preferably high in the control of each of the first head units 10*a*. On the other hand, since each of the second head units 10*b* is positioned far from the driver IC 28, the ink temperature changes slowly. Therefore, there is no need to refer to the temperature frequently in the control of the second head units 10*b*. Accordingly, the frequency of the temperature correction for the second head units 10*b* is decreased, and thus the control thereof becomes easy.

The wording "the reference frequency of the temperature is changed" means that a time interval after the temperature was referred to most recently until the temperature is referred to next is varied between the driving of each first head unit 10*a* and the driving of each second head unit 10*b*. An example is given below. That is, the ink discharging operation of each head unit 10 and the transport operation of the print paper P by the transport mechanism 4 are alternately performed in the printing on the print paper P as described above. Here, with respect to each first head unit 10*a*, the temperature is referred to every time the ink discharging operation and the transport operation are executed once. On the other hand, with respect to the second head units 10*b*, the temperature at the position, at which the second temperature sensor 22 is arranged, is referred to every time after the ink discharging operation and the transport operation are performed twice.

Then, the drive circuit 24 of the driver IC 28 outputs the drive signal to each of the six head units 10 to drive each of the head units 10 (S13). After the printing is performed on one first print paper P1 (S14: Yes), the process proceeds to S19.

<Second Drive Mode>

In a case that the controller 6 judges in S10 that the printing is performed on the second print paper P2 having the small width, the control circuit 25 selects the second drive mode for allowing the drive circuit 24 to drive only the four second head units 10*b* upon the judgment (S15). In a case that the second drive mode is selected, the drive circuit 24 generates the drive signal for each of the four second head units 10*b* (S16). In this situation, the temperature detected by the second temperature sensor 22, which is provided commonly for the four second head units 10*b*, is referred to, and the drive signal is corrected depending on the detected temperature.

Then, the drive circuit 24 outputs the drive signal to each of the four head units 10*b* to drive each of the second head units 10*b* (S17). After the printing is performed on one second print paper P2 (S18: Yes), the process proceeds to S19.

In a case that the printing on another print paper P is continuously performed after the completion of the printing on one first print paper P1 or one second print paper P2 (S19: Yes), the process returns to S10. In a case that the printing is not continuously performed (S19: No), the print process is completed.

Next, modified embodiments in which the above-described embodiment is variously modified will be explained. However, components having the structures similar to those of the above-described embodiment will be denoted by the same reference numerals and symbols, and explanation thereof will be omitted when appropriate.

For example, the number of temperature sensors, the arrangement of the temperature sensor(s), etc., can be modified as follows.

A plurality of second temperature sensors 22 may be provided for the second head units 10*b* so that the number of second temperature sensors 22 is smaller than the number of the second head units 10*b*. For example, in a ease that there are four second head units 10*b*, two or three second temperature sensors 22 may be provided. In the case that the plurality of second temperature sensors 22 are provided, the temperature correction may be performed, for example, by using an average value of the temperatures detected by the plurality of second temperature sensors 22.

In the above embodiment, the first head units 10*a* positioned close to the driver IC 28 are used only for the printing on the first print paper P1, and the second head units 10*b* positioned away from the driver IC 28 are used for both the printing on the first print paper P1 and the printing on the second print paper P2, that is, the first head units 10*a* are used differently from the second head units 10*b*. However, irrespective of the different uses of the head units 10, the arrangement of each of the temperature sensors may be designed depending on whether each of the corresponding head units 10 is positioned close to or away from the driver IC 28.

Figure 6:
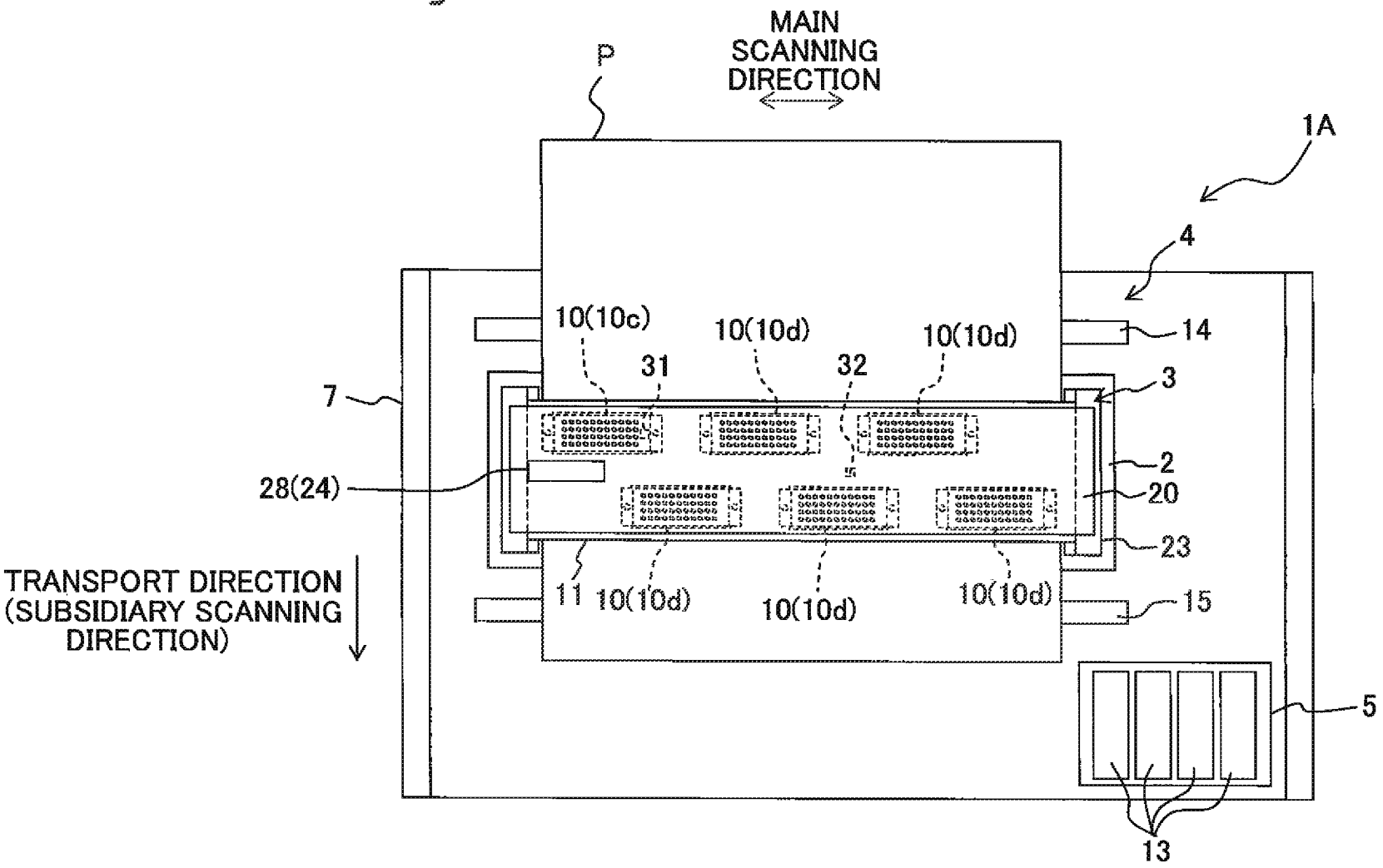
FIG. 6 is a schematic plan view of a printer according to a modified embodiment.

An example of a printer 1A according to this modified embodiment is shown in FIG. 6. Similar to FIG. 1, the inkjet head 3 includes the six head units 10 also in FIG. 6. In the modified embodiment, however, all of the six head units 10 are used for the printing on one type of print paper P and there is no situation in which only some of the head units 10 are used by themselves. Then, as shown in FIG. 6, a dedicated temperature sensor 31 is provided in one head unit 10*c*, of the six head units 10, positioned closest to the side of the driver IC 28. Meanwhile, a temperature sensor 32 is provided commonly for the remaining five head units 10*d* so that the number of the temperature sensor 32 is fewer than the number of the head units 10 (one temperature sensor 32 is provided in the modified embodiment). Each of the five head units 10*d* positioned away from the driver IC 28 has the change in the ink temperature smaller than that of the head unit 10*c* positioned close to the driver IC 28, and further the temperature variation in the five head units 10*d* is small. Therefore, there is no problem even when the temperature sensor 32 is not individually provided for each of the five head units 10*d*.

Also in the modified embodiment, the reference frequency of the temperature sensor 31, which is provided for the head unit 10*c* positioned close to the driver IC 28, may be different from the reference frequency of the temperature sensor 32, which is provided commonly for the five head units 10*d* positioned away from the driver IC 28. That is, the reference frequency of the temperature sensor 31 at the time of controlling the head unit 10*c* may be higher than the reference frequency of the temperature sensor 32 at the time of controlling the five head units 10*d*.

In the above embodiment, the temperature sensor 21 is provided on the lower surface of one of the head units 10 facing the print paper P and the temperature sensor 22 is provided on the lower surface of the head holder 11. However, since the ink is more likely to be adhered to the temperature sensors 21, 22 in this configuration, each temperature sensor may be provided at a part (for example, the upper surface or the side surface), of each head unit 10 or the head holder 11, which is not opposed to the print paper P.

In the above embodiment, the control circuit 25 controlling the drive circuit 24 is incorporated into one driver IC 28. However, the following configuration is also allowable. That is, the control circuit is incorporated into a substrate (for example, the head substrate 20) different from the driver IC 28 and a signal for controlling the drive circuit 24 is inputted to the driver IC 28 from the control circuit exterior to the driver IC 28.

In the above embodiment, the problem, which is caused by the heat generated in the driver IC 28 having the drive circuit 24 which drives the head units 10, has been explained. In this regard, a heating element other than the driver IC 28 (drive circuit 24) may exist. For example, in a ease that a power supply unit supplying the power to the driver IC 28 is installed in the head substrate 20 in the printer 1 of FIG. 1, when the head units 10 are driven by the driver IC 28, the heat generated in the power unit is higher than that generated in the driver IC 28 in some cases. Further, the present teaching is not limited to the embodiment in which the heating element such as the power supply unit is provided in the head substrate 20 positioned above each head unit 10. The heating element may be provided in another member such as the head holder 11.

The ink-jet head 3 of the above embodiment is the so-called line-type ink-jet head in which the head units 10 are arranged in a paper width direction. The present teaching, however, may be applied to a so-called serial-type ink-jet head in which the ink is jetted while the ink-jet head is moving in the paper width direction, as shown in FIG. 7, for example.

Figure 7:
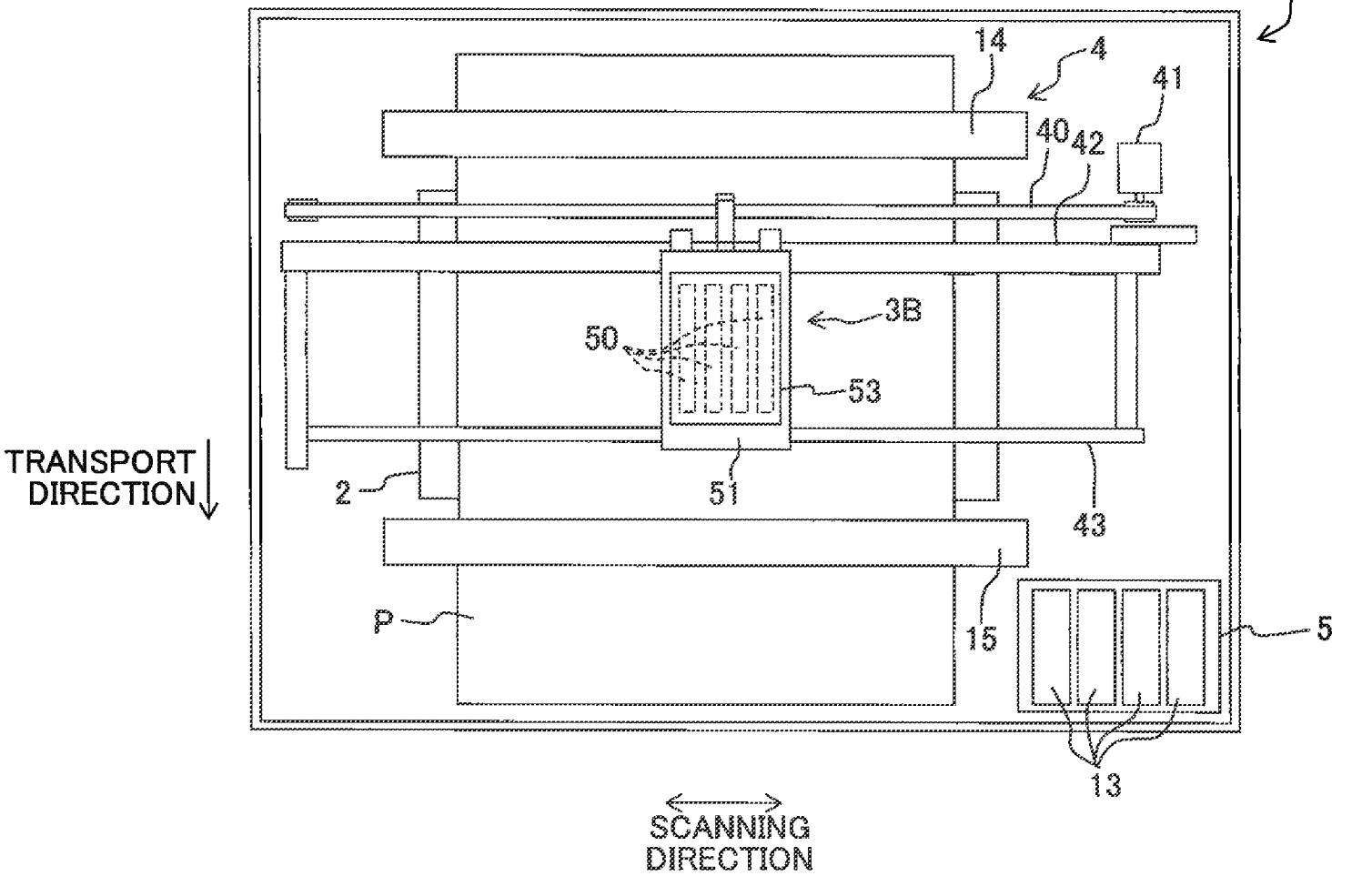
FIG. 7 is a schematic plan view of a printer according to another modified embodiment.

As shown in FIG. 7, a printer 19 includes the platen 2, an ink-jet head 3B, the transport mechanism 4, the holder 5, and the like. The structures of the platen 2, the transport mechanism 4, and the holder 5 are similar to those of the above embodiment, and thus explanation thereof will be omitted. The ink-jet head 3B will be explained below.

An endless belt 40 is coupled to the ink-jet head 3B. By driving the endless belt 40 by a motor 41, the ink-jet head 3B moves in the scanning direction (left-right direction in FIG. 7; the width direction of the print paper P) perpendicular to the transport direction (up-down direction in FIG. 7) of the print paper P along two guide rails 42, 43.

Figure 8:
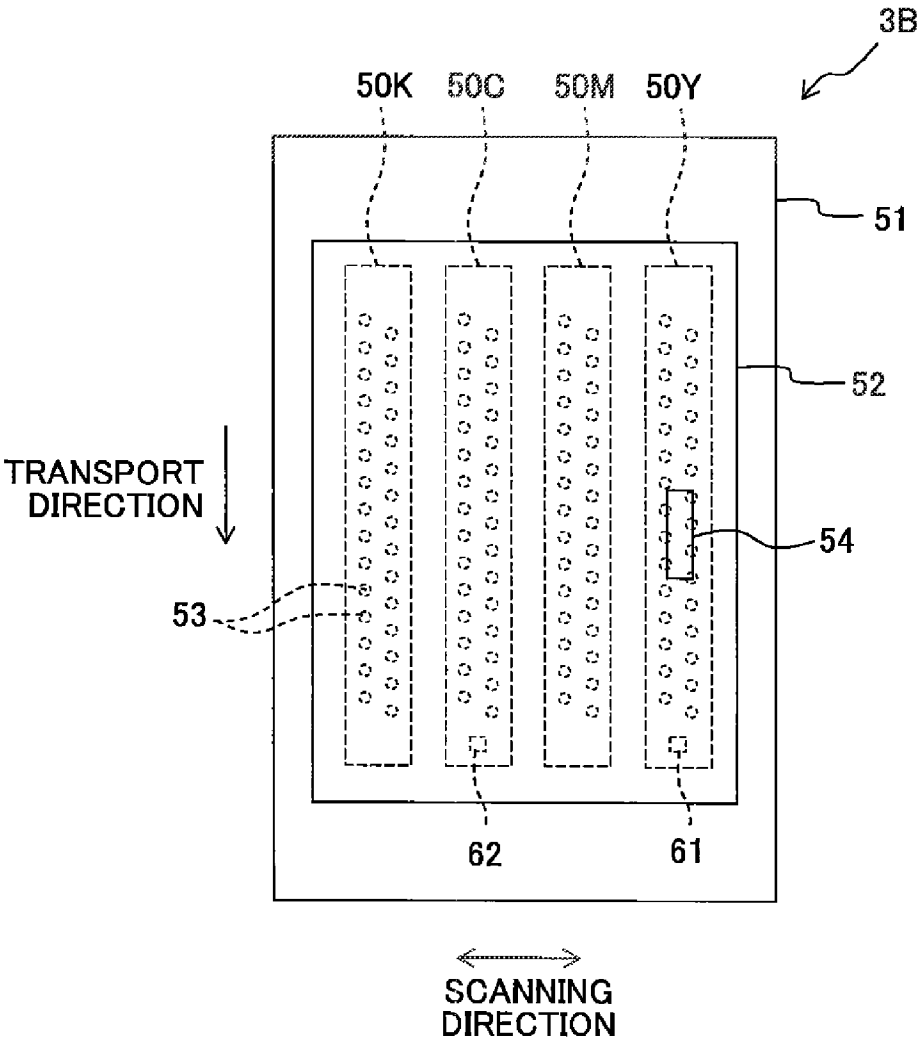
FIG. 8 is a plan view of an ink-jet head shown in FIG. 7.

As shown in FIG. 8, the ink-jet head 3B includes a head holder 51 and four head units 50 attached to the head holder 51 and arranged in the scanning direction, and a head substrate 52 arranged above the four head units 50.

As shown in FIG. 8, each of the head units 50 includes a plurality of nozzles 53 which are aligned in two arrays in a zigzag or staggered form in the transport direction. The four head units 50 are respectively connected to four ink cartridges 13 of the holder 5, and four colors of inks (black, yellow, cyan, magenta) are supplied from the four ink cartridges 13, respectively. As shown in FIG. 8, the four head units 50 which correspond to the four colors of inks respectively are arranged in the order of black (K), cyan (C), magenta (M), and yellow (Y) in the scanning direction from the left side of FIG. 8.

As shown in FIG. 8, a driver IC 54 is provided on the upper surface of the head substrate 52, The driver IC 54 is provided at a right end of the head substrate 52, namely at a position immediately above a yellow head unit SOY. Similar to the above embodiment, the drive circuit (not shown) for driving each of the head units 50 and the control circuit (not shown) for controlling the drive circuit are incorporated in the driver IC 54.

In a case that color printing, in which each of the four colors of inks is used to print an image and the like, is performed on the print paper P, a head control circuit of the head substrate 52 drives all of the four head units 50 (first drive mode). On the other hand, in a case that monochrome (black and white) printing, in which only the black ink is used to print letters and the like, is performed, the head control circuit drives only the black head unit 50K (second drive mode). Here, the head unit 50K (an example of the second head unit of the present teaching) which may be used solely in the second drive mode is positioned separated farther from the driver IC 54 as the heating element than the remaining three colors of head units 50C, 50M, 50Y. Therefore, with respect to the second drive mode at the time of performing the monochrome printing, the increase in the ink temperature in the head unit 50K caused by the heat from the driver IC 54 is small to suppress the change in the jetting characteristics owing to the influence of the heat generated in the driver IC 54, and thereby making it possible to discharge the ink successfully.

Of the four colors of inks including black, cyan, magenta, and yellow, the color of the yellow ink is light. Thus, even when the jetting characteristics of each nozzle 53 of the yellow head unit 50Y change slightly to cause the change in the amount of liquid droplets and the deviation of landing positions in some degree, the change and the deviation are inconspicuous. In other words, even when the jetting characteristics of each nozzle 53 of the four head units change equally, the influence on print quality is small in the yellow ink. In view of this, the yellow head unit 50Y (an example of the first head unit of the present teaching) is arranged at a position closest to the driver IC 54 in FIG. 8.

Further, temperatures sensors 61, 62 each detecting the ink temperature are provided for the four head units 50. By referring to the temperature detected by each of the temperature sensors 61, 62, the head control circuit controls the driver IC 54 to drive each of the units 50.

Here, the head unit 50Y, of the four head units 50, which is positioned on the rightmost side is arranged closest to the driver IC 54 as the heating element. Thus, the ink temperature of the head unit SOY changes greatly. Then, the temperature sensor 61 detecting the ink temperature is provided exclusively for the head unit 50Y. By referring to the temperature detected by the temperature sensor 61, the head control circuit controls the driver IC 54 to drive the head unit 50Y.

Meanwhile, the three head units 50K, 50C, 50M positioned on the left side are arranged farther separated from the driver IC 54 than the yellow head unit 50Y. Therefore, the ink temperature of each of the head units 50K, 50C, 50M changes gradually and the temperature variation among the three head units 50K, 50C, 50M is small. Then, one temperature sensor 62 is provided commonly for the three head units 50. In FIG. 8, the temperature sensor 62 is provided in the head unit 50C, of the three head units 50K, 50C, 50M, which is disposed at the center position. By referring to the temperature detected by the common temperature sensor 62, the head control circuit controls the driver IC 54 to drive each of the three head units 50K, 50C, 50M. Noted that, two temperature sensors 62 may be provided for the three head units 50K, 50C, 50M. By making the number of the temperature sensors 62, which are provided for the three head units 50K, 50C, 50M arranged away from the driver IC 54, fewer than the number of the head units 50, the cost can be reduced.

The ink temperature of the head unit 50Y positioned close to the driver IC 54 changes greatly, and the ink temperatures of the three head units 50K, 50C, 50M positioned away from the driver IC 54 change gradually. Therefore, the reference frequency of the temperature detected by the temperature sensor 61 for controlling the head unit 50Y may be higher than the reference frequency of the temperature detected by the temperature sensor 62 for controlling the three head units 50K, 50C, 50M.

The temperature sensors 61, 62 may be arranged as follows. That is, in FIG. 8, the temperature sensor 61 is provided individually for each of the yellow head unit 50Y positioned closest to the driver IC 54 and the magenta head unit 50M positioned second-closest to the driver IC 54, and one temperature sensor 62 is provided commonly for the remaining two head units 50K, 50C positioned on the left side.

In the embodiment and the modified embodiments as described above, the present teaching is applied to the ink-jet printer which discharges the ink on the print paper to print the image etc. The present teaching, however, can be also applied to a liquid jetting apparatus used in various uses other than the printing of the image etc. For example, the present teaching can be also applied to a liquid jetting apparatus which jets a conductive liquid on a board to form a conductive pattern on the surface of the board.

What is claimed is:

1. A liquid jetting apparatus, comprising:

a first head unit and a second head unit, each of the head units including nozzles through which a liquid is discharged;

a head drive section configured to drive the first head unit and the second head unit;

a controller configured to control the head drive section to selectively execute a first drive mode in which both of the first head unit and the second head unit are driven and a second drive mode in which only the second head unit is driven; and a heating element in the head drive section configured to generate heat under a condition that the head drive section executes the first drive mode and the second drive mode, wherein the second head unit is arranged at a position separated farther from the heating element than the first head unit.

2. The liquid jetting apparatus according to claim 1, further comprising a head substrate connected to the first head unit and the second head unit;

wherein the heating element is disposed on the head substrate.

3. The liquid jetting apparatus according to claim 1, further comprising a first temperature detecting section provided for the first head unit individually and configured to detect a temperature of the liquid of the first head unit;

wherein the controller is configured to control the head drive section to drive the first head unit based on the temperature of the liquid detected by the first temperature detecting section.

4. The liquid jetting apparatus according to claim 3;

wherein the second head unit is provided as a plurality of second head units;

wherein at least one second temperature detecting section configured to detect a temperature at a position, at which the at least one second temperature detecting section is arranged, as a temperature of the liquid of the second head units is provided commonly for the second head units;

wherein the number of the second temperature detecting section is fewer than the number of the second head units; and wherein the controller is configured to control the head drive section to drive the second head units based on the temperature detected by the second temperature detecting section.

5. The liquid jetting apparatus according to claim 4;

wherein in the first drive mode, the controller is configured to refer to the temperature detected by the first temperature detecting section for controlling driving of the first head unit more frequently than the temperature detected by the second temperature detecting section for controlling driving of the second head units.

6. The liquid jetting apparatus according to claim 1;

wherein the first head unit and the second head unit are arranged in a predetermined direction;

wherein the liquid jetting apparatus further includes a transport mechanism configured to transport a medium, on which the liquid discharged from the nozzles lands, in a direction intersecting with the predetermined direction;

wherein the transport mechanism is configured to transport at least a first medium and a second medium having a width in the predetermined direction which is smaller than that of the first medium;

wherein the transport mechanism is configured to transport the second medium so that the second medium is positioned in an area, within a transport area of the first medium, on a side of the second head unit in the predetermined direction; and wherein the controller is configured to:

control the head drive section to execute the first drive mode, in a case that the first medium is transported by the transport mechanism; and control the head drive section to execute the second drive mode, in a case that the second medium is transported by the transport mechanism.

7. The liquid jetting apparatus according to claim 1;

wherein an identical type of liquid is discharged from the nozzles of the first head unit and the nozzles of the second head unit.

8. The liquid jetting apparatus according to claim 7;

wherein an ink of an identical color is discharged from the nozzles of the first head unit and the nozzles of the second head unit.

9. A liquid jetting apparatus, comprising:

at least three head units, each of which includes nozzles through which a liquid is discharged;

a head drive section configured to drive the head units;

a controller configured to control the head drive section; and a heating element in the head drive section configured to generate heat under a condition that the head drive section drives the head units;

wherein the head units include at least one first head unit arranged close to the heating element and a plurality of second head units, each of which is arranged at a position separated farther from the heating element than the at least one first head unit;

wherein at least one first temperature detecting section configured to individually detect a temperature of the liquid of the at least one first head unit is provided for the at least one first head unit individually;

wherein at least one second temperature detecting section configured to detect a temperature at a position, at which the at least one second temperature detecting section is arranged, as a temperature of the liquid of the second head units is provided commonly for the second head units; and wherein the number of the second temperature detecting section is fewer than the number of the second head units.

10. The liquid jetting apparatus according to claim 9, further comprising a head substrate connected to the at least one first head unit and the plurality of second head units;

wherein the heating element is disposed on the head substrate.

11. The liquid jetting apparatus according to claim 10;

wherein the at least one second temperature detecting section is disposed on the head substrate at a position adjacent to each of the plurality of second head units.

12. The liquid jetting apparatus according to claim 10;

wherein the at least one first temperature detecting section is disposed directly on the at least one first head unit.

13. The liquid jetting apparatus according to claim 10, further comprising a carriage carrying the first head unit, the second head unit, the heating element, and the head substrate, and configured to he movable in a predetermined direction.

14. The liquid jetting apparatus according to claim 13;

wherein the first head unit and the second head unit are arranged in the predetermined direction;

wherein different types of inks are discharged from the nozzles of the first head unit and the nozzles of the second head unit, respectively; and wherein a color of the ink discharged from the nozzles of the first head unit is lighter than a color of the ink discharged from the nozzles of the second head unit.

15. A liquid jetting apparatus, comprising:

a first head unit and a second head unit, each of the head units including nozzles through which a liquid is discharged;

a head drive section configured to drive the first head unit and the second head unit;

a controller configured to control the head drive section to selectively execute a first drive mode in which both of the first head unit and the second head unit are driven and a second drive mode in which only the second head unit is driven; and a heating element configured to generate heat under a condition that the head drive section executes the first drive mode and the second drive mode;

wherein the second head unit is arranged at a position separated farther from the heating element than the first head unit; and wherein the heating element is a power supply unit for supplying power to the head drive section.

16. A liquid jetting apparatus, comprising:

at least three head units, each or which includes nozzles through which a liquid is discharged;

a head drive section configured to drive the head units;

a controller configured to control the head drive section; and a heating element configured to generate heat under a condition that the head drive section drives the head units;

wherein the head units include at least one first head unit arranged close to the heating element and a plurality of second head units, each of which is arranged at a position separated farther from the heating element than the at least one first head unit;

wherein at least one first temperature detecting section configured to individually detect a temperature of the liquid of the at least one first head unit is provided for the at least one first head unit individually;

wherein at least second temperature detecting section configured to detect a temperature at a position, at which the at least one second temperature detecting section is arranged, as a temperature of the liquid of the second head units is provided commonly for the second head units;

wherein the number of the second temperature detecting section is fewer than the number of the second head units; and wherein the heating element is a power supply unit for supplying power to the head drive section.

* * * * *